United States Patent [19]

Edwards et al.

[11] 4,356,963

[45] Nov. 2, 1982

[54] FLOW ADJUSTMENT MECHANISM FOR AIR DISTRIBUTION SYSTEMS

[75] Inventors: Douglas F. Edwards, Jackson County, Mo.; Raymond H. Dean, Shawnee Mission, Kans.

[73] Assignee: Tempmaster Corporation, Kansas City, Mo.

[21] Appl. No.: 289,497

[22] Filed: Aug. 3, 1981

[51] Int. Cl.[3] ..... F24F 7/06

[52] U.S. Cl. ..... 236/49; 74/568 R

[58] Field of Search ..... 236/49, 82, 80 F, 80 R; 137/84; 74/568 R

[56] References Cited

U.S. PATENT DOCUMENTS

| | | | |
|---|---|---|---|
| 2,307,214 | 1/1943 | Gollmer | 74/568 |
| 3,125,109 | 3/1964 | Kreuter | 236/82 |
| 3,602,241 | 8/1971 | Puster | 236/82 X |
| 3,941,310 | 3/1976 | Travaglio et al. | 236/49 |
| 3,994,434 | 11/1976 | Boyer et al. | 236/49 |
| 4,077,567 | 3/1978 | Ginn et al. | 236/49 |
| 4,231,515 | 11/1980 | Ring, Jr. | 236/49 |
| 4,291,832 | 9/1981 | Ginn et al. | 236/49 |
| 4,312,475 | 1/1982 | Edwards et al. | 236/49 |

*Primary Examiner*—William E. Tapolcai

*Attorney, Agent, or Firm*—Kokjer, Kircher, Bradley, Wharton, Bowman & Johnson

[57] ABSTRACT

An improved adjustment mechanism for adjusting the maximum flow rate of conditioned air in an air distribution system controlled by a pneumatic control circuit. An air bladder controls the distribution of air, and the pressure is bled from the bladder under the control of a diaphragm against which pressure is fed back from the downstream side of the bladder. The control orifice through which the bladder pressure is exhausted is formed in the end of an exhaust tube that is axially adjustable. A cam and set screw arrangement provides a field adjustment for the exhaust tube to move the control orifice toward and away from the diaphragm for adjustment of the maximum flow rate. The cam has three point contact provided by a pair of feet and a second set screw which permits adjustment of the inclination of the cam surface. Rocking of the cam is prevented by a spring which counters the force applied to the cam by the first set screw.

11 Claims, 5 Drawing Figures

Fig. 1.
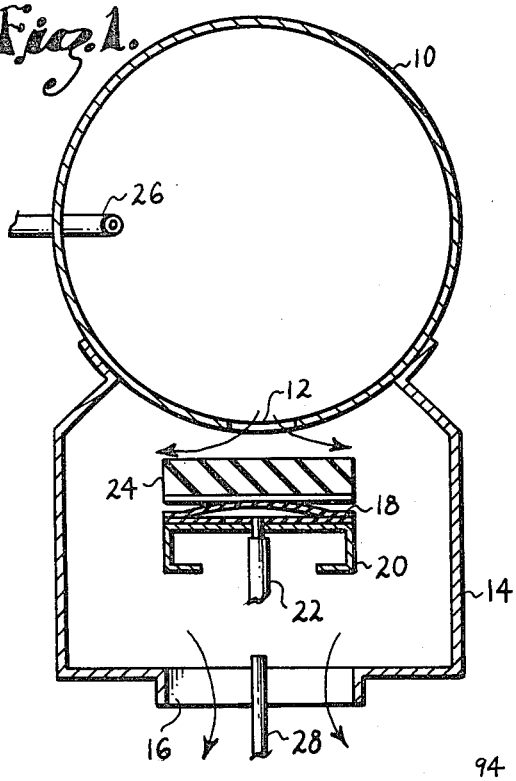
Fig. 2.
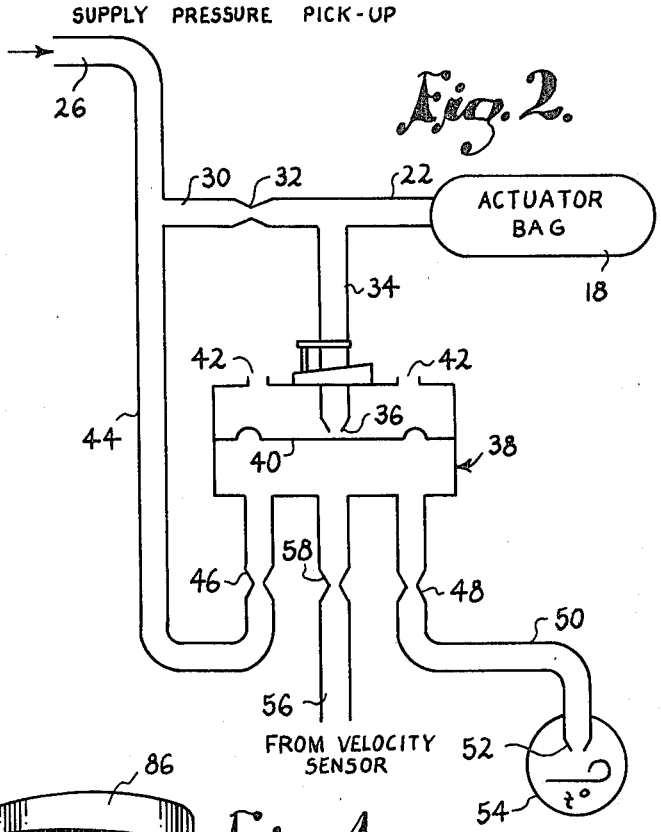
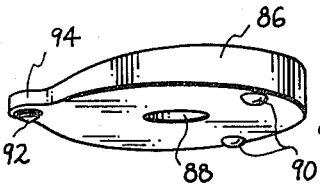
Fig. 4.
Fig. 3.
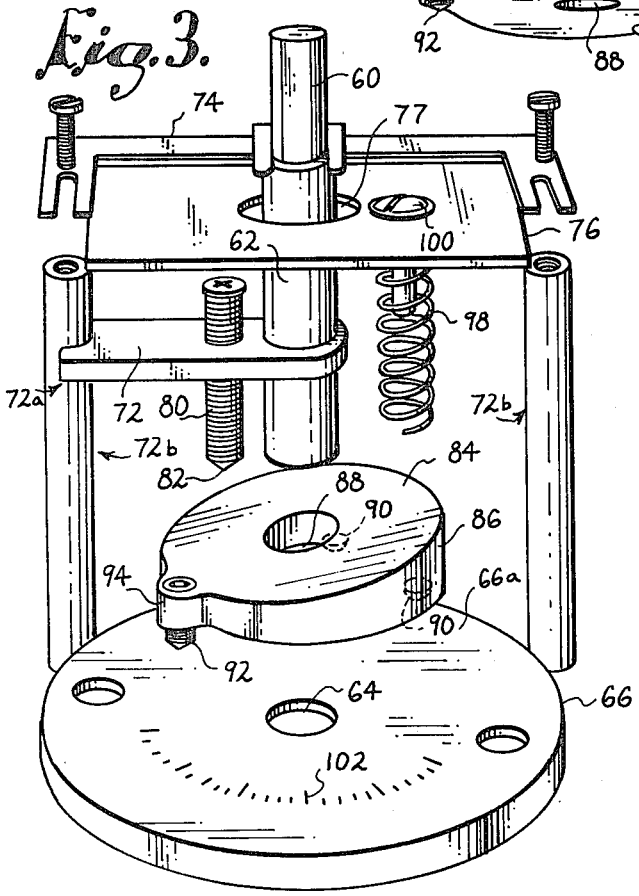
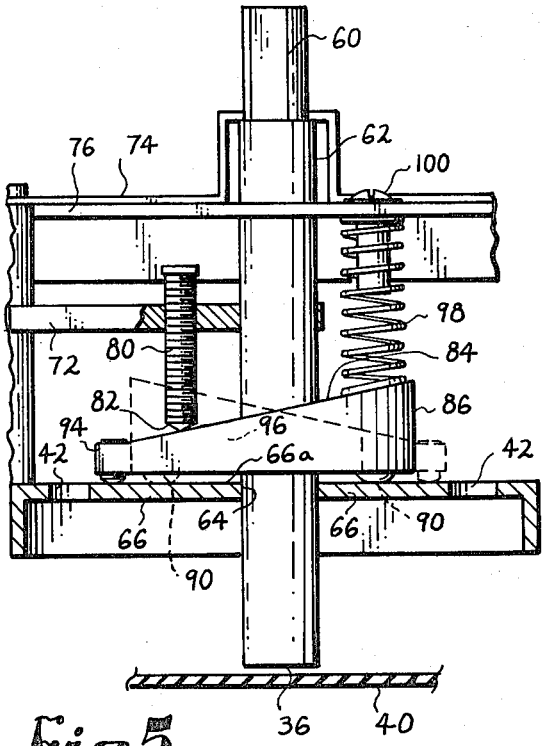
Fig. 5.

FLOW ADJUSTMENT MECHANISM FOR AIR DISTRIBUTION SYSTEMS

BACKGROUND OF THE INVENTION

This invention relates in general to a pneumatic circuit for controlling an air distribution system. More specifically, the invention relates to an improvement in the adjustment mechanism shown in pending application Ser. No. 201,226, filed Oct. 27, 1980 by Douglas F. Edwards, Ronald S. Zimmer and Raymond H. Dean, now U.S. Pat. No. 4,312,475.

The heating and cooling of relatively large buildings such as office buildings is normally accomplished by passing conditioned air through ventilating ducts which direct the conditioned air to separate rooms of the building. Individual temperature control for the separate offices or other sections of the building is achieved by controlling the volume of air flow through the duct or through the air outlet which discharges the conditioned air from the duct into the room. Typically, a flow control device is provided in the duct or outlet to regulate the flow of conditioned air to an air diffuser or similar outlet device, thereby controlling the room temperature. This type of air distribution system is generally high in efficiency and low in cost since it utilizes a single large heating or cooling unit to supply several rooms or floors of the building. At the same time, there is no sacrifice in the individual temperature control for each office.

As disclosed subsequently herein, it is possible in this type of air distribution system to provide a pneumatic control circuit that controls the flow rate of conditioned air such that it is virtually independent of the main supply pressure. As a result, the fluctuations that inevitably occur in the supply pressure have no appreciable effect on the flow of conditioned air into the room that is to be heated or cooled. Although such control circuits function well for the most part, the fact that the maximum air flow is constant is sometimes detrimental to the performance of the system. In many instances, it is desirable to provide a field adjustable upper limit on the maximum air flow. It is also desirable to provide an independent factory calibration of the maximum flow rate in order to compensate for any small physical variations that are present in the mechanical components of the system.

The aforementioned Edwards et al application discloses a mechanism that effectively adjusts the maximum flow rate in an air distribution system while eliminating many of the problems inherent in needle valves and other adjustable restrictions. Nevertheless, this device has not been wholly without problems. Perhaps most notably, the angle of the cam surface is fixed for a given cam, and the device is thus sometimes incapable of effectively accommodating diaphragms that vary significantly in elasticity. The fixed cam angle can be too shallow to provide a meaningful adjustment for diaphragms that are particularly stiff, while the same cam angle can be too steep for highly flexible diaphragms.

Another problem arises when there is substantial clearance between the tube and the opening through which it extends in the top of the control. If the tube fits loosely in the opening, relatively small external forces applied to the tube can rock it about the fulcrum of the set screw and thus upset the setting and calibration of the device. For example, when the set screw is on a low area of the cam and an upward or sideward force is applied to the tube the loose fit of the tube permits it to rock or tilt upwardly about the screw tip to raise the control orifice slightly away from the underlying diaphragm. Conversely, application of a downward force tilts the lower end of the tube downwardly to move the control orifice closer to the diaphragm. In either event, the control orifice is inadvertently shifted in a manner to throw off the calibration and setting of the mechanism, and its accuracy and effectiveness suffer accordingly.

The coiled compression spring included in the device is not able to effectively resist lateral deflection of the tube, and the spring provides little assistance in countering the tendency for the tube to rock about the set screw. Actually, the spring force tends to twist the tube and thereby adds to the frictional forces when the tube slides up and down. The vertical sliding friction increases the calibration and setting hysteresis and reduces the accuracy and sensitivity of the control.

Another problem with the device disclosed in the Edwards et al application is that the "feel" differs depending upon whether the set screw is moving up or down the incline of the cam surface. When the cam is turned in a direction to raise the tube, the set screw must ride up the cam surface and considerable resistance is encountered. Lowering of the tube is accomplished without similar resistance because the set screw then moves down the cam surface and there is no spring force to overcome. The overall result is that there is unequal resistance to turning of the cam, and there is a corresponding lack of good "feel" to the cam mechanism. Unequal resistance to turning of the cam can also cause it to tilt or rock.

SUMMARY OF THE INVENTION

The present invention is directed to an improvement in the mechanism of the aforementioned Edwards et al application, and the principal goal of the invention is to provide a flow adjustment mechanism which eliminates the problems discussed previously herein. In accordance with the invention, a flow adjustment device is constructed in substantially the same manner shown in the pending Edwards et al application. However, rather than riding flatly on the underlying support surface, the cam has three point contact therewith provided by a pair of feet and an adjustable set screw threaded through the low end of the cam. The set screw can be adjusted to vary the inclination of the cam surface to accommodate diaphragms which vary in elasticity.

An added compression spring contacts the cam surface at a location to counterbalance the force applied thereto by the adjustment screw. The tendency for the cam to tilt about the screw is counteracted by the added spring, and the spring equalizes the "feel" of the device since there is equal resistance to turning of the cam in either direction. A leaf spring urges the tube downwardly and offers resistance to lateral deflection of the tube due to the stiffness of the leaf spring. Rocking of the tube is thus eliminated, and the leaf spring has the further advantage of reducing the friction force that resists sliding of the tube.

DETAILED DESCRIPTION OF THE INVENTION

In the accompanying drawing which forms a part of the specification and is to be read in conjunction therewith and in which like reference numerals are used to indicate like parts in the various views:

FIG. 1 is a sectional view taken on a vertical plane through a ventilation duct and air diffuser forming part of an air distribution system which is equipped with a pneumatic control circuit and an adjustment mechanism constructed according to a preferred embodiment of the present invention;

FIG. 2 is a schematic diagram of the pneumatic control circuit;

FIG. 3 is an exploded perspective view of the adjustment mechanism which is associated with the pneumatic control circuit;

FIG. 4 is a bottom perspective view of the cam included in the adjustment mechanism; and FIG. 5 is a fragmentary elevational view of the adjustment mechanism, with portions broken away for illustrative purposes.

Referring initially to FIG. 1, numeral 10 identifies a cylindrical duct which receives conditioned air from a suitable heating or cooling unit (not shown). The conditioned air is supplied to duct 10 at a relatively high supply pressure and is discharged from the duct at a relatively low pressure through an elongate outlet slot 12 formed in the bottom of the duct. An air diffuser 14 receives the air discharged through slot 12 and distributes the air to a room or other area which is to be heated or cooled. The air is directed into the room through a slot 16 in the bottom of the air diffuser.

The flow of conditioned air through slot 12 is controlled by an inflatable air bag or bladder 18 which is shown in the fully deflated condition in FIG. 1. Bladder 18 is supported on top of a metal pan 20 located within the diffuser structure 14. Air for inflation of bladder 18 is supplied thereto by a conduit 22. A foam pad 24 is disposed above bladder 18 and is moved toward and away from slot 12 upon inflation and deflation of the bladder. When the bladder is fully inflated, pad 24 seals slot 12 to prevent discharge of air therefrom. In the fully deflated condition of the bladder shown in FIG. 1, pad 24 is located well below slot 12 to permit the conditioned air to flow essentially freely out of the slot and into the room.

A supply pressure pickup fitting 26 picks up the main supply pressure of the conditioned air in duct 10. Fitting 26 is in the form of an open ended tube having its open end facing in a direction to receive the air which is forced through duct 10 by a fan (not shown). A flow sensor 28 is located adjacent slot 16 on the low pressure side of bladder 18 in order to sense the quantity of the air discharged through slot 12. The flow sensor 28 may take the form of an open ended tube having its open end facing upwardly within the diffuser structure 14 and below slot 12. Alternatively, the flow sensor may be a long perforated manifold. The pressure in the flow sensor is determined primarily by the pressure drop across the diffuser which directs air into the room.

Referring now more particularly to the pneumatic control circuit shown in FIG. 2, the supply pressure pickup fitting 26 has a Tee connection with a conduit 30 which leads to the conduit 22 which supplies the actuator bag or bladder 18. The conduit 30 is provided with an orifice 32 having a diameter of approximately 0.045" in a preferred form of the invention. An exhaust line 34 serves to bleed pressure from bladder 18 in order to effect deflation of the bladder and increase flow through slot 12. The exhaust line 34 connects at a right angle with conduit 22. Line 34 terminates in a control orifice 36 which is located within the casing of an amplifying relay generally indicated at 38. Orifice 36 is located centrally above a flexible diaphragm 40 mounted within the casing of the relay. The upper side of diaphragm 40 is vented to atmosphere through one or more vent openings 42, and the pressure above diaphragm 40 is thus atmospheric except for the small area of orifice 36. It is to be noted that when diaphragm 40 is displaced upwardly, it closes off the control orifice 36 to prevent bleeding of pressure from bladder 18. The weight of the diaphragm, in cooperation with a spring (not shown) if desired, urges the diaphragm downwardly toward the open position. As will be more fully explained, the distance of the control orifice 36 from diaphragm 40 is adjustable.

A conduit 44 extends from the intersection between fitting 26 and conduit 30 and into the bottom of relay 38 to communicate with the underside of diaphragm 40. Conduit 44 has an orifice 44 which is located between conduit 30 and the underside of the diaphragm and has a diameter of approximately 0.007" in a preferred form of the invention. Conduit 44 serves to apply the supply pressure, through orifice 46, to the underside of diaphragm 40.

Extending from the underside of the diaphragm 40 is a short conduit 50 which is provided with a limiting orifice 48 and a terminating orifice 52. Orifice 48 preferably has a diameter of approximately 0.020". A conventional thermostat 54 is located in the room that is to be heated or cooled and responds to temperature changes in a manner to open and close orifice 52. For example, if the air distribution system is operating in the cooling mode, thermostat 54 is set to open orifice 52 to an equivalent diameter much larger than that of orifice 48 when the temperature in the room exceeds the temperature level set on the thermostat. When the room temperature is below the setting of the thermostat, orifice 52 is closed.

The velocity sensor 28 connects with a conduit 56 which leads through an orifice 58 to the underside of diaphragm 40. The relatively low pressure at the velocity sensor is thus transmitted through orifice 58 and is applied against the underside of diaphragm 40 along with the pressure transmitted through orifice 46. In a preferred embodiment of the invention, orifice 58 has a diameter of approximately 0.010". The size of orifice 58 is thus considerably less than that of orifice 48 but is greater than that of orifice 46.

Referring now to FIGS. 3 and 4 in particular, the present invention provides a mechanism which is used to adjust the distance of orifice 36 from the upper surface of diaphragm 40. In accordance with the invention, the exhaust tube 34 includes a flexible tube 60 which connects at one end with conduit 22. The opposite end of tube 60 is telescopingly received in a somewhat larger tube 62. Tubes 60 and 62 are in fluid communication with one another, and the control orifice 36 is formed in the lower end of tube 62 which isConsequently, extension of tube 62 moves orifice 36 closer to diaphragm 40, while retraction of tube 62 moves the control orifice away from the diaphragm. Tube 62 extends into the housing of relay 38 through an opening 64 formed in the top portion 66 of the housing. Tube 62 has a flat bar 72 connected thereto having a fork 72*a* which can slide vertically on the fixed post 72*b*, thus preventing tube 62 from rotating.

The flat bar 72 is rigidly connected with tube 62 in outward projection therefrom. Tube 62 is continuously urged downwardly toward diaphragm 40 by a leaf spring 74 secured to a bracket 76 and fixed post 72*b* having an arm which presses down on the top end of tube 62. The bracket 76 permits the tube assembly to be mounted on a stationary support 72*b*. Tube 62 fits loosely through a relatively large opening 77 in bracket 76 such that the leaf spring 74 continuously urges bar 72 and tube 62 downwardly toward diaphragm 40.

A set screw 80 is threaded through bar 72 at a location outboard of tube 62. The set screw 80 is parallel to tube 62 and terminates in a pointed tip 82 which rides on an incline cam surface 84 of cam 86. The cam 86 is received on the flat upper surface 66*a* of housing 66 and has a central opening 88 (FIG. 3) which loosely receives tube 62. Cam 88 is thus rotatable on surface 66*a* about the axis of the tube. The cam surface 84 is inclined relative to surface 66*a* and the axis of tube 62 such that rotation of the cam moves set screw 80 up and down by camming action. The set screw thus acts as a cam follower.

Cam 86 has three point contact with surface 66*a* provided by a pair of spaced apart feet 90 and a small set screw 92 which is threaded through a lug 94 formed on the low or thin end of the cam. Feet 90 are integral with the bottom surface of cam 86 and have rounded surfaces that contact surface 66*a*. The feet are located on the thick portion of the cam, and when the cam is positioned with its thick portion below screw 80 as shown in broken lines in FIG. 5, an imaginary straight line extending between feet 90 is located substantially below the point of contact between tip 82 and cam surface 84 although slightly outwardly of said point of contact. More specifically, an imaginary straight line 96 extending normal to cam surface 84 from its point of contact with screw 80 in the position of the cam shown in broken lines in FIG. 5 intersects with the midpoint of an imaginary straight line extending between feet 90.

Screw 92 serves as an adjustment member which can be threaded downwardly to lessen the inclination of cam surface 84 or upwardly to increase the inclination of the cam surface. This adjustability permits the device to accommodate diaphragms of varying elasticity, as will be explained more fully.

A coiled compression spring 98 is secured at its top end to the underside of bracket 76 by a screw 100 in a threaded cylinder 100*a*. The lower end of spring 98 acts against cam surface 84 at a location on the opposite side of tube 62 from the point of contact of screw 82 with the cam surface. Screw 82 and spring 98 contact the cam surface at locations substantially equidistant from the axis of tube 62 and spaced 180° apart about the tube axis.

A graduated scale 102 is provided on the upper surface 66*a* of housing 66 and extends in an arcuate configuration thereon. Set screw 92 serves as a pointer which cooperates with scale 102 to indicate the setting of the adjustment mechanism.

In operation, the pneumatic circuit controls the extent to which bladder 18 is inflated and thus controls the flow of conditioned air into the room that is being heated or cooled. If the air distribution system is operating in the cooling mode and the room temperature is at or below the setting of thermostat 54, the thermostat is closed. The supply pressure is then transmitted through conduits 30 and 44 (and through orifice 46) to the underside of diaphragm 40, thereby forcing the diaphragm upwardly to close orifice 36. Since this closes exhaust line 34, the supply pressure is applied to bladder 18 (through orifice 32) to inflate the bladder and thus close off the outlet slot 12 of duct 10. The pressure at the velocity sensor 28 is essentially atmospheric pressure under these conditions. A typical supply pressure at fitting 26 is approximately 1" W.G., while a typical pressure on the closed or bottom side of diaphragm 40 is approximately 0.1" W.G. Consequently, the pressure differential across orifice 46 is considerably greater than the differential across orifice 58, and the constriction provided by orifice 58 permits the pressure to build up below diaphragm 40 to the extent necessary to effect closing of the control orifice 36. The result is that bladder 18 is maintained in a fully inflated condition to close off slot 12 when there is no demand for cool air.

If the temperature in the room rises above the setting of thermostat 54, the thermostat opens to bleed off the pressure below diaphragm 40 through orifice 48 and the thermostat orifice 52. The constriction provided by the small (0.007") orifice 46 permits the pressure below diaphragm 40 to approach atmospheric pressure, and the weight of the diaphragm causes it to move downwardly to open orifice 36. Pressure is then bled from bladder 18 through the exhaust line 34 and through orifice 36 and the vent opening 42. This effects deflation of bladder 18 and opens slot 12 to permit conditioned air to flow into the foam. As the flow through the duct outlet increases, the pressure increases at the velocity sensor 28, and, if the flow becomes high enough, the pressure at the velocity sensor builds up to the level necessary to close diaphragm 40. The velocity sensor pressure is applied through orifice 58 to the underside of the diaphragm, and eventually an equilibrium or balance point is reached where a relatively constant flow of conditioned air is directed into the room. An excessively high rate of air flow into the room is precluded due to the action of the velocity sensor.

When thermostat 54 is partially open, the pressure below diaphragm 40 is maintained by a combination of the supply pressure, as transmitted through conduits 30 and 44, and the velocity sensor pressure, as transmitted through conduit 56. If the flow through opening 12 is low, the pressure at the velocity sensor is relatively low and there is not enough pressure applied to the underside of the diaphragm to maintain it closed. Consequently, the control orifice 36 is open and air is bled from bladder 18, thereby increasing the air flow through slot 12. Conversely, if the air flow is relatively high, the flow at the velocity sensor increases the pressure below the diaphragm to effect closing of the control orifice 36. The bladder pressure then increases, and the air flow eventually reaches its balance point.

It is thus apparent that the control function of the pneumatic circuit is nearly independent of the main supply pressure in duct 10. For a given position of the thermostat, the flow of conditioned air is determined primarily by the pressure that is fed back to relay 38 from the velocity sensor. The feedback signals from the velocity sensor automatically compensate for variations in the main supply pressure to provide a control circuit which is pressure independent for all practical purposes.

The small pressure dependencies that are present in the control circuit arise from the fact that the supply pressure in duct 10 is transmitted to opposite sides of diaphragm 40. Changes in the supply pressure are transmitted through conduit 44 and orifice 46 to the bottom of the diaphragm, thus tending to close orifice 36 and decrease the air flow with increasing supply pressure. This effect is small compared to the feedback from velocity sensor 28 because orifice 46 is smaller than orifice 58. Countering this effect is the effect of the application of the main supply pressure to the top of the diaphragms through conduits 30 and 34. This pressure tends to open orifice 36 with increasing supply pressure, thereby increasing the air flow. Again, the feedback from the velocity sensor is much greater than the effect of the supply pressure because the area under orifice 36 is small compared to the total area of the diaphragm.

These two pressure dependent effects oppose one another and thus tend to cancel. By proper selection of the sizes of orifices 46, 48, and 58 as indicated previously, they can be made to exactly cancel or become negligible. If a needle valve or other adjustable restriction is used in conduit 50 to control the maximum flow, the size of orifice 48 compared to orifices 46 and 58 is effectively changed and the pressure independence of the control system is destroyed.

The amplifying relay 38 provides both flow gain and pressure gain so that a small orifice thermostat controls a relatively high flow into and out of the bladder 18, thus providing a quick response to changes in the demand for conditioned air. A number of different units operating at radically different supply pressures can be controlled from a single thermostat without significant adverse effects, because all of the control pressures can be controlled from a single thermostat without significant adverse effects, because all of the control pressures and signals are referenced to a single common pressure (atmospheric pressure). The velocity signals from all of the units are independent of supply pressure since the velocity signals depend only on the flow through the respective diffusers.

Rather than adding a high velocity pressure or pressure differential on the high pressure side of the bladder, the pneumatic circuit utilizes the pressure drop across the diffuser downstream of the actuator bag for control purposes. This pressure differential is necessary for good air distribution in the occupied space, so it is not necessary to add any pressure at all for control purposes. Consequently, the number of pressure sensitive components is minimized and the fan energy is not used for purposes of control. Since only a single diaphragm 40 is necessary in order to achieve control that is virtually independent of pressure, the pneumatic circuit is reduced in cost and complexity as compared to control systems which require a number of diaphragms and similar pressure sensitive elements. It is to be understood that the pneumatic control circuit functions equally well to control the distribution of heated air.

Without the adjustment mechanism shown in FIGS. 3–5, the maximum air flow through slot 12 is constant. The adjustment mechanism provides for adjustment of the maximum flow rate simply by rotating cam 86. For example, by rotating the cam 180° from the solid line position of FIG. 5 to the broken line position, the air flow is adjusted from its minimum setting to its maximum setting. As the cam rotates, its upper camming surface 84 pushes set screw 80 upwardly by camming action to raise bar 72 and the exhaust tube 62. Consequently, the bottom end of tube 62 and the control orifice 36 that is formed therein are moved upwardly from the solid line position to the broken line position. In the broken line position, the orifice is spaced well away from diaphragm 40 so that relatively high pressure is required at flow sensor 28 in order to move the diaphragm upwardly far enough to reach the equilibrium condition of orifice 36. To achieve this high pressure at the flow sensor 28, a high rate of air flow through slot 12 is required, and the maximum rate of flow is relatively high. conversely, when tube 62 is in the solid line position of FIG. 4, orifice 36 is relatively close to the diaphragm such that a small flow rate can displace the diaphragm upwardly to effect the equilibrium condition of the orifice.

The leaf spring 74 maintains the tip of set screw 80 in contact with the cam surface 84 at all times. Therefore, when the cam 86 is moved from the broken line position of FIG. 5 to the solid line position, tube 62 moves downwardly under the influence of the spring. The threaded set screw permits independent factory calibration of the adjustment mechanism in order to compensate for any variations in the mechanical parts. By threading screw 80 upwardly or downwardly, the distance of orifice 36 from diaphragm 40 is adjusted at any particular rotative position of cam 86. The factory calibration is thus completely independent of the field adjustment provided by cam 86. The pointer provided by screw 92 visually indicates on scale 90 the setting of the cam, and the setting is preferably indicated in terms of the percent of maximum air flow. For example, when cam 86 is in the solid line position of FIG. 5, pointer 92 could read 50% on the scale to indicate that cam 86 is set at 50% of the maximum flow rate, while in the broken line positin the pointer would read 100% on the scale. Halfway in between the solid and broken line positions, pointer 92 would indicate 75% on the scale. The rotative position of cam 86 and thus the reading on the scale corresponds to the distance of orifice 36 from diaphragm 40.

Since the diaphragms with which the adjustment device is used can vary significantly in elasticity, a given inclination of cam surface 84 can be too severe for some diaphragms and too gradual for others. Compensation is made for such diaphragm variations by the adjustable set screw 92 which can be threaded downwardly to lessen the inclination of cam surface 84 or upwardly to increase its inclination, thus permitting the cam angle to be calibrated to match the elasticity of the particular diaphragm employed. Factory calibration is accomplished by initially positioning the cam 86 at the maximum flow setting wherein the thick part of the cam is positioned below screw 80, as shown in broken lines in FIG. 5. Screw 80 is then adjusted until the maximum desired flow rate is achieved. The cam is then rotated to the minimum flow setting (solid line position of FIG. 5), and the other screw 92 is adjusted until the minimum setting is properly calibrated. Due to the position of the feet 90, small adjustments of screw 92 have only negligible effect on the maximum flow setting. Consequently, when the cam is again turned to the maximum flow position following adjustment of screw 92, the original maximum flow setting is still applicable, and accurate calibration is achieved.

In the maximum flow setting of cam 86, feet 90 are located very nearly below screw 80, and there is a resulting tendency for the cam to tilt or rock about the feet. This tendency is countered by spring 98 which counterbalances the downward force applied to the cam by screw 80. Spring 98 also provides better "feel" since it results in equal resistance to cam movement regardless of the direction of rotation of the cam. When cam 84 is turned in one direction, screw 80 rides up the cam surface 84 to provide resistance, and spring 98 rides up the cam surface to provide substantially equal resistance when the cam is turned in the opposite direction. Therefore, the action of spring 98 provides the cam with a good "feel", as well as resisting the tendency for the cam to rock or tip.

When tube 62 has a relatively loose fit in opening 64, forces applied to the upper portion of the tube tend to rock or tilt it about the fulcrum of the tip 82 of screw 80, thereby causing inaccuracies. This undesirable tilting of the tube is prevented by the leaf spring 74 which is securely attached to the top of the tube and which is stiff enough to resist lateral deflection of the tube. Since the tube is thus prevented from deflecting laterally at its top end, it is also prevented from rocking about the tip of screw 80, and undesirable vertical displacement of orifice 36 is prevented. The overall result is that the device retains its calibration even when subjected to roughly applied external forces. The leaf spring 74 also reduces the vertical sliding friction of the tube, which reduces the calibration and setting hysteresis and improves the accuracy and sensitivity of the device.

It is pointed out that the adjustment device does not require expensive seals or twisting of any connecting tubes during adjustment. Additionally, there are no off-center or hard to reproduce torques applied to the diaphragm. The introduction of any possible leaks on the high pressure or bottom side of diaphragm 40 is avoided. Any leakage which may occur is restricted to the area above diaphragm 40, and this side of the diaphragm is vented to atmosphere so that any such leaks have no detrimental effect on the system. It is again pointed out that the factory calibration provided by set screw 80 is independent of the field adjustment provided by cam 86, and that neither of these settings alters the size relationship among the orifices 46, 48 and 58. As a result, the adjustment mechanism has no effect on the pressure independence of the control circuit.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In an air distribution system, a mechanism for adjusting the amount of pressure induced deflection of a diaphragm that is necessary for the diaphragm to close a control orifice located adjacent one side of the diaphragm, said mechanism comprising:

a tube terminating in said control orifice and supported for generally axial movement toward and away from the diaphragm to vary the distance of said control orifice from said one side of the diaphragm, thereby varying the amount of deflection of the diaphragm necessary for same to cover said control orifice;

a stationary flat surface through which said tube extends;

a cam on said flat surface supported to rotate about the axis of said tube and having a cam surface inclined relative to said flat surface;

a cam follower carried on said tube at a location offset from the axis thereof;

yieldable means for urging said tube in a direction to maintain said cam follower against said cam surface, whereby rotation of said cam effects camming interaction between said cam surface and cam follower to effect axial movement of said tube; and an adjustment member carried on said cam at a location offset from the axis of said tube, said adjustment member contacting said flat surface and being extensible and retractable relative to said cam to adjust the inclination of said cam surface relative to said flat surface thereby varying the extent of axial movement of said tube effected by rotating said cam.

2. A mechanism as set forth in claim 1, including a stationary bracket, said yieldable means comprising a leaf spring connected with said bracket and acting against said tube in a manner to urge same toward said diaphragm while resisting lateral deflection of the tube.

3. A mechanism as set forth in claim 2, including a compression spring between said bracket and cam surface acting on the cam surface at a location thereon to substantially counteract the force applied to the cam surface by said cam follower, said tube being located between said spring and cam follower.

4. A mechanism as set forth in claim 1, including spring means acting on said cam surface at a location wherein said tube is between said spring means and cam follower, said spring means substantially counteracting the force applied to said cam surface by said cam follower to resist tilting of said cam about the cam follower.

5. A mechanism as set forth in claim 1, including a pair of spaced apart feet on said cam, said feet and adjustment member providing three point contact of said cam with said flat surface.

6. A mechanism as set forth in claim 5, wherein said feet are located on an imaginary straight line passing generally beneath said cam follower in a preselected position of said cam.

7. A mechanism as set forth in claim 6, wherein said imaginary line is located to be intersected by another imaginary line extending substantially normal to

8. In an air distribution system controlled by a pneumatic circuit of the type having an inflatable bladder for controlling the distribution of conditioned air, a flexible diaphragm, means for applying pressure to one side of the diaphragm, and thermostat means for controlling the application of pressure to said one side of the diaphragm, the improvement comprising:

a first tube communicating at one end thereof with said bladder;

a second tube coupled with said first tube for axial extension and retraction relative thereto and in fluid communication therewith;

a control orifice in said second tube adjacent a side of said diaphragm opposite said one side thereof, whereby pressure applied to said one side of the diaphragm displaces same toward said control orifice to reduce bleeding of pressure from the bladder;

a substantially flat surface supported in a stationary position and receiving said second tube in extension therethrough;

a cam supported on said flat surface for rotation about the axis of said second tube, said cam having a cam surface inclined relative to said flat surface;

a cam follower carried on said tube at a location offset from the axis thereof;

yieldable means for urging said cam follower against said cam surface to effect movement of said control orifice toward and away from said diaphragm in response to turning of said cam; and an adjustment member carried on said cam at a location offset from the axis of said tube, said adjustment member being in contact with said flat surface and being extensible and retractable relative to said cam to adjust the inclination of said cam surface with respect to said flat surface.

9. The improvement set forth in claim 8, including resilient means acting against said cam surface to counteract the force applied thereto by said cam follower, said resilient means being offset approximately 180° from said cam follower about said tube.

10. The improvement set forth in claim 8, wherein said yieldable means comprises a leaf spring acting against said second tube to urge said cam follower against said cam surface and resisting lateral movement of the second tube.

11. The improvement set forth in claim 8, including a pair of spaced apart feet on said cam, said feet and adjustment member providing three point contact between said cam and said flat surface.

* * * * *